US007839253B2

(12) United States Patent
Lu et al.

(10) Patent No.: US 7,839,253 B2
(45) Date of Patent: Nov. 23, 2010

(54) COUPLED INDUCTOR STRUCTURE

(75) Inventors: Hsin-Chia Lu, Taipei (TW); Tzu-Wei Chao, Taipei (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 12/757,431

(22) Filed: Apr. 9, 2010

(65) Prior Publication Data

US 2010/0194514 A1 Aug. 5, 2010

Related U.S. Application Data

(62) Division of application No. 11/906,946, filed on Oct. 4, 2007, now Pat. No. 7,696,853.

(30) Foreign Application Priority Data

Mar. 20, 2007 (TW) ..... 96109439 A

(51) Int. Cl.
*H01F 5/00* (2006.01)

(52) U.S. Cl. ..... 336/200

(58) Field of Classification Search ..... 336/65, 336/83, 200, 205–208, 232; 257/531
See application file for complete search history.

(56) References Cited

U.S. PATENT DOCUMENTS 6,384,705 B1 5/2002 Huang et al.
7,057,488 B2 * 6/2006 Van Haaren et al. ..... 336/200
7,095,307 B1 8/2006 Barrett et al.
7,535,330 B2 5/2009 Erickson et al.
2005/0195061 A1 * 9/2005 Terrovitis ..... 336/200

* cited by examiner

*Primary Examiner*—Tuyen Nguyen
(74) *Attorney, Agent, or Firm*—Peter F. Corless; Steven M. Jensen; Edwards Angell Palmer & Dodge LLP

(57) ABSTRACT

A coupled inductor structure applied in a first dielectric layer and a second dielectric layer disposed under the first dielectric layer includes a first inductor element disposed on the first dielectric layer and a second inductor element disposed on the second dielectric layer. The first inductor element has a first bending segment, a second bending segment connected to the first bending segment, and a third bending segment connected to the second bending segment. The second bending segment of the first inductor element has on the second dielectric layer a projection intersecting a second bending segment of the second inductor element. A relative position of the first bending segment of the first inductor element to a first bending segment of the second inductor element is opposite to another relative position of the third bending segment of the first inductor element to a third bending segment of the second inductor element.

13 Claims, 6 Drawing Sheets

COUPLED INDUCTOR STRUCTURE

CROSS-REFERENCE TO RELATED APPLICATION(S)

This application is a divisional of copending application U.S. Ser. No. 11/906,946, filed on Oct. 4, 2007.

BACKGROUND OF THE INVENTION

1. Field of the Invention

The present invention is related to coupled inductor structures, and more particularly, to a coupled inductor structure applied in multiple dielectric layers.

2. Description of Related Art

The multi-layer structure in such as an LTCC (low temperature co-fired ceramic) process gives designers great freedom in designing inductors, capacitors and transmission lines. However, inductors larger than 5 nH are not easy to implement by spiral or helix shapes due to size and self-resonant frequency limitations. In the paper "Design of miniature multilayer on-package integrated image-reject filters" written by Albert Sutono, Joy Laskar and W. R. Smith in the IEEE Trans. Microwave Theory and Tech., vol. MTT-51 part 1, pp. 156~162. January 2003, a larger equivalent inductance value is achieved through a coupled inductor structure and a bandpass filter at 2.5 GHz is further implemented through the coupled inductor structure. In addition, in the paper "A Compact second-order LTCC bandpass filter with two finite transmission zeros" written by Lap Kun Yeung and Ke-Li Wu in the IEEE Trans. Microwave Theory and Tech., vol. MTT-51 No. 2, pp. 337~341, February 2003, a bandpass filter is implemented through two parallel coupled inductors disposed at different layers with separation of about 100 μm.

Although inductance value can be increased through the structures proposed in the above-described papers, problem of misalignment between upper and lower layers occurring in stacking of layers in a LTTC process cannot be prevented. Typically, the misalignment is in the range of 20 μm~50 μm, which can result in a dimension error of up to 20%~50% and result in frequency deviation of the bandpass filter.

With reference to FIGS. 1*a* and 1*b*, a schematic representation of a conventional coupled inductor is shown. $L_1$ and $L_2$ represent self-inductance values of two separated inductors without any coupling. Nodes A and B respectively represent port 1 and port 2 of the conventional coupled inductor. When the two separated inductors are brought close to each other, magnetic coupling can occur. M denotes the mutual inductance value between the two separated inductors. The schematic of FIG. 1*a* can be transformed into an equivalent circuit of FIG. 1*b*, wherein inductance values $LL_1$, $LL_2$ and MM of FIG. 1*b* are calculated through following equations:

$$LL_1 = \frac{L_1 L_2 - M^2}{L_2 - M}$$

$$LL_2 = \frac{L_1 L_2 - M^2}{L_1 - M}$$

$$MM = \frac{L_1 L_2 - M^2}{M}$$

By adjusting the mutual inductance value M between the two inductors, a desired larger equivalent inductance value MM can be obtained.

With reference to FIG. 2, a conventional multi-layer coupled inductor structure is shown, which achieves a larger equivalent inductance value based on the foregoing equations. As shown in FIG. 2, the multi-layer coupled inductor structure includes a first dielectric layer 10, a second dielectric layer 11, a top grounding layer 12 and a bottom grounding layer 13, wherein the first dielectric layer 10 has a substantially J-shaped metallic conductive wire 101 with a first opening 101*a*, the second dielectric layer 11 has a substantially J-shaped metallic conductive wire 111 with a second opening 111*a* facing a direction opposite to that of the first opening 101*a* of the conductive wire 101. The conductive wires 101, 111 respectively have self-inductance values L1, L2. Magnetic coupling occurs between two segment portions 101*b*, 111*b* of the conductive wires 101, 111 that are parallel to Y-axis and generates a mutual inductance value M. As described earlier, placing the two parallel segment portions 101*b*, 111*b* of the conductive wires 101, 111 at different layers does provide more freedom to designers in controlling the distance between them. However, the misalignment between the first and second dielectric layers 10, 11 can change the mutual inductance value between the conductive wires and further affect the equivalent inductance value MM. To be more specific, a straight-line coupled inductor has a size of about hundreds of micrometers in Y-axis, which is far more larger than size of the inductor in X-axis. As a result, the misalignment between the first dielectric layer 10 and the second dielectric layer 11 in X-axis has great influence on the coupled inductance.

U.S. Pat. No. 6,873,221 B2 with a title of "Multilayer Balun with High Process Tolerance" reduces degradation effects attributed to misalignment between layers by dividing a straight coupled line into two segments mutually vertical to one another. Although the technique adopted reduces the change of mutual inductance value, it does not offset the change in left-right displacement. Therefore, there still exists a problem that the mutual inductance value exceeds a permissible range due to too big change of the displacement.

Therefore, developing a technique to prevent horizontal deviation in the process from affecting inductor elements in different dielectric layers so as to prevent inductance value of the coupled inductor from exceeding a permissible range becomes critical.

SUMMARY OF THE INVENTION

In view of the drawbacks of the prior art, an objective of the present invention is to provide a coupled inductor structure, which can prevent horizontal deviation in the process from affecting inductor elements in different dielectric layers so as to prevent inductance value of the coupled inductor from exceeding a permissible range.

According to one embodiment of the present invention, the coupled inductor structure is applied in a plurality of dielectric layers having at least one first dielectric layer and one second dielectric layer disposed under the first dielectric layer, the coupled inductor structure comprises: at least one first inductor element disposed on the first dielectric layer, the first inductor element at least comprising a first signal connecting port, a first bending segment connected to the first signal connecting port, a second bending segment connected to the first bending segment, a third bending segment connected to the second bending segment and a second signal connecting port connected to the third bending segment; and at least one second inductor element disposed on the second dielectric layer, the second inductor element at least comprising a first signal connecting port, a first bending segment connected to the first signal connecting port, a second bending segment connected to the first bending segment, a third bending segment connected to the second bending segment and a second signal connecting port connected to the third bending segment, wherein, the second bending segment of the first inductor element has on the second dielectric layer a projection intersecting with the second bending segment of the second inductor element, relative position of the first bending segment of the first inductor element to the first bending segment of the second inductor element is opposite to the relative position of the third bending segment of the first inductor element to the third bending segment of the second inductor element.

According to one embodiment of the present invention, the first inductor element further comprises a fourth bending segment and a fifth bending segment disposed between the third bending segment and the second signal connecting port, wherein the fourth bending segment is connected to the third bending segment and the fifth bending segment is connected to the fourth bending segment and the second signal connecting port; the second inductor element further comprises a fourth bending segment and a fifth bending segment disposed between the third bending segment and the second signal connecting port, wherein the fourth bending segment is connected to the third bending segment and the fifth bending segment is connected to the fourth bending segment and the second signal connecting port, the fourth bending segment of the first inductor element has on the second dielectric layer a projection intersecting with the fourth bending segment of the second inductor element, and the relative position of the fourth bending segment of the first inductor element to the fourth bending segment of the second inductor element is opposite to the relative position of the second bending segment of the first inductor element to the second bending segment of the second inductor element, the relative position of the fifth bending segment of the first inductor element to the fifth bending segment of the second inductor element is same as the relative position of the first bending segment of the first inductor element to the first bending segment of the second inductor element.

Affects of horizontal deviation on the inductor elements in different dielectric layers can be obviated through the intersecting and reversal structure design of the inductor elements, thereby preventing inductance value of the coupled inductor from exceeding a permissible range.

BRIEF DESCRIPTION OF THE DRAWINGS

Further characteristics and advantages of the invention will be more apparent from reading the following detailed description, which has been provided as a non-limiting example and has been made with reference to the appended drawings, in which.

DETAILED DESCRIPTION OF THE PREFERRED EMBODIMENTS

The present invention is described in the following so that one skilled in the pertinent art can easily understand other advantages and effects of the present invention. Note that the drawings provided herein are all simplified schematic views illustrating the basic structure of the present invention and the components applied are not limited to what is shown in the preferred embodiments. The present invention may also be implemented and applied according to other embodiments, and the details may be modified based on different views and applications without departing from the spirit of the invention.

First Embodiment

Figure 1A:
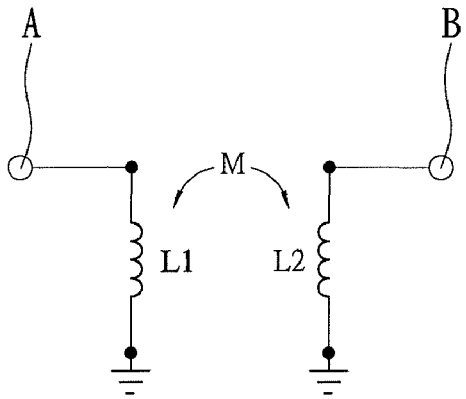
FIGS. 1*a* and 1*b* are schematic circuitry of a conventional coupled inductor.
Figure 1B:
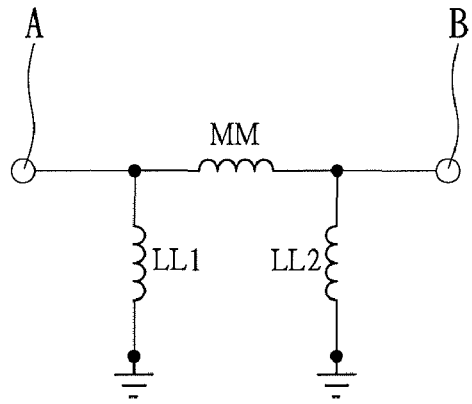
Figure 2:
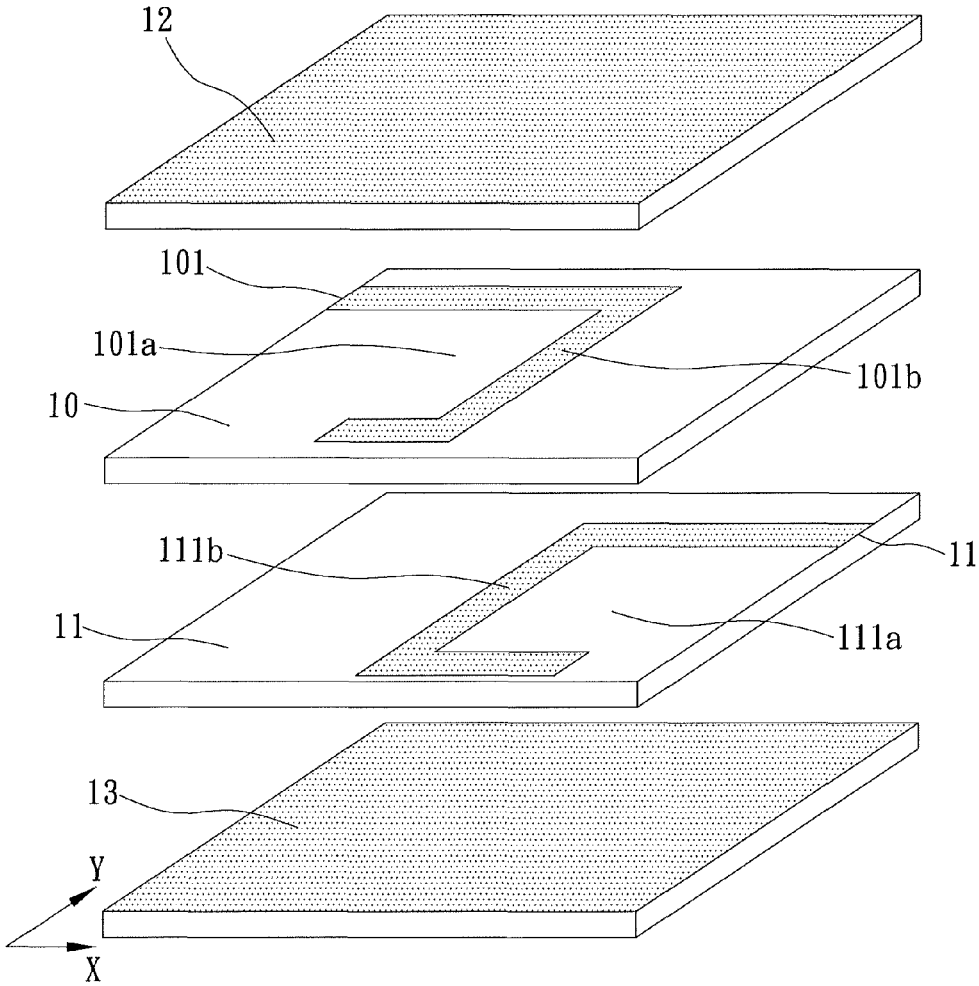
FIG. 2 is an exploded perspective view of a conventional multi-layer coupled inductor structure.
Figure 3A:
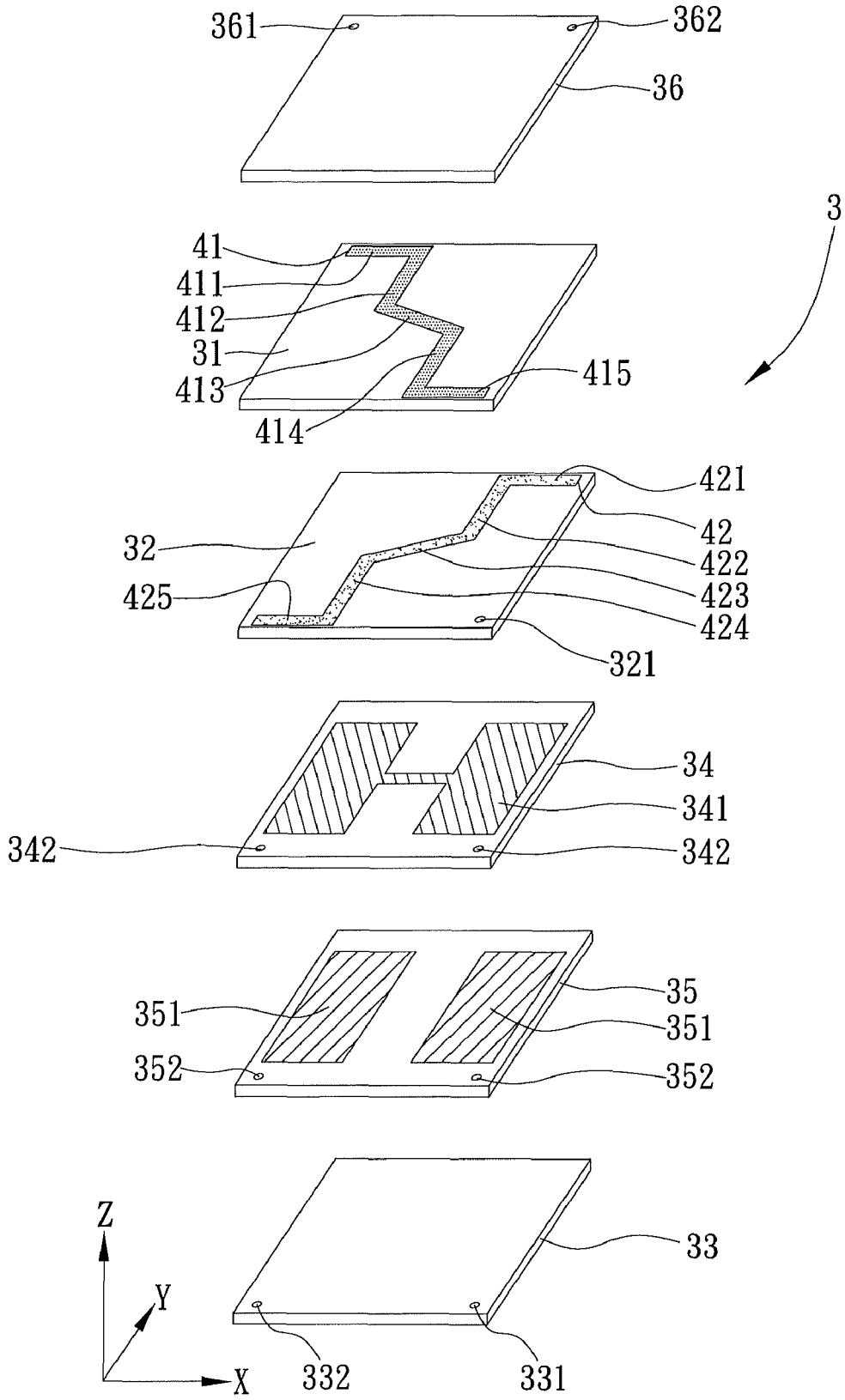
FIG. 3*a* is an exploded perspective view showing a coupled inductor structure according to the present invention.

With reference to FIG. 3*a*, an exploded view of a coupled inductor structure according to a first embodiment of the present invention is shown. As shown in the drawing, the coupled inductor structure is applied in a plurality of dielectric layers 3 comprising at least one first dielectric layer 31 and one second dielectric layer 32 disposed under the first dielectric layer 31 and having an electrically conductive through hole 321.

The coupled inductor structure according to the present invention comprises a first inductor element 41 disposed on the first dielectric layer 31 and a second inductor element 42 disposed on the second dielectric layer 32. It is appreciated to those skilled in the art that variation in the quantity of the inductor elements, the first inductor element 41 and/or the second inductor element 42, is easily accomplished without departing from the spirit of the present invention and involves only routine practice in the field such that the change in numbers of the inductor elements shall still be encompassed by the scope of the present invention.

The first inductor element 41 at least comprises a first signal connecting port 411, a first bending segment 412 connected to the first signal connecting port 411, a second bending segment 413 connected to the first bending segment 412, a third bending segment 414 connected to the second bending segment 413 and a second signal connecting port 415 connected to the third bending segment 414. More specifically, one end of the first bending segment 412 is connected to one end of the first signal connecting port 411 and the other end of the first bending segment 412 is connected to one end of the second bending segment 413, and the other end of the second bending segment 413 is further connected to one end of the third bending segment 414, and the other end of the third bending segment 414 is further connected to the second signal connecting port 415, and the second signal connecting port 415 is further connected to the electrically conductive through hole 321 of the second dielectric layer 32. In this preferred embodiment, the second signal connecting port 415 is a grounding port.

In other embodiments, length of the first signal connecting port 411 may be zero, that is, the first signal connecting port 411 is directly formed on the first bending segment 412; and length of the second signal connecting port 415 may also be zero, that is, the second signal connecting port 415 is directly formed on the third bending segment 414.

The second inductor element 42 at least comprises a first signal connecting port 421, a first bending segment 422 connected to the first signal connecting port 421, a second bending segment 423 connected to the first bending segment 422, a third bending segment 424 connected to the second bending segment 423 and a second signal connecting port 425 connected to the third bending segment 424. More specifically, one end of the first bending segment 422 is connected to one end of the first signal connecting port 421 and the other end of the first bending segment 422 is connected to one end of the second bending segment 423, and the other end of the second bending segment 423 is further connected to one end of the third bending segment 424, and the other end of the third bending segment 424 is further connected to the second signal connecting port 425. It is to be noted that the first and second inductor elements 41, 42 have substantially same structure and connection. An only difference between them is that they are disposed at positions opposite to each other. The second signal connecting port 425 is a grounding port.

In other embodiment, length of the first signal connecting port 421 may be zero, that is, the first signal connecting port 421 is directly formed on the first bending segment 422; and length of the second signal connecting port 425 may also be zero, that is, the second signal connecting portion 425 is directly formed on the third bending portion 424.

Figure 3B:
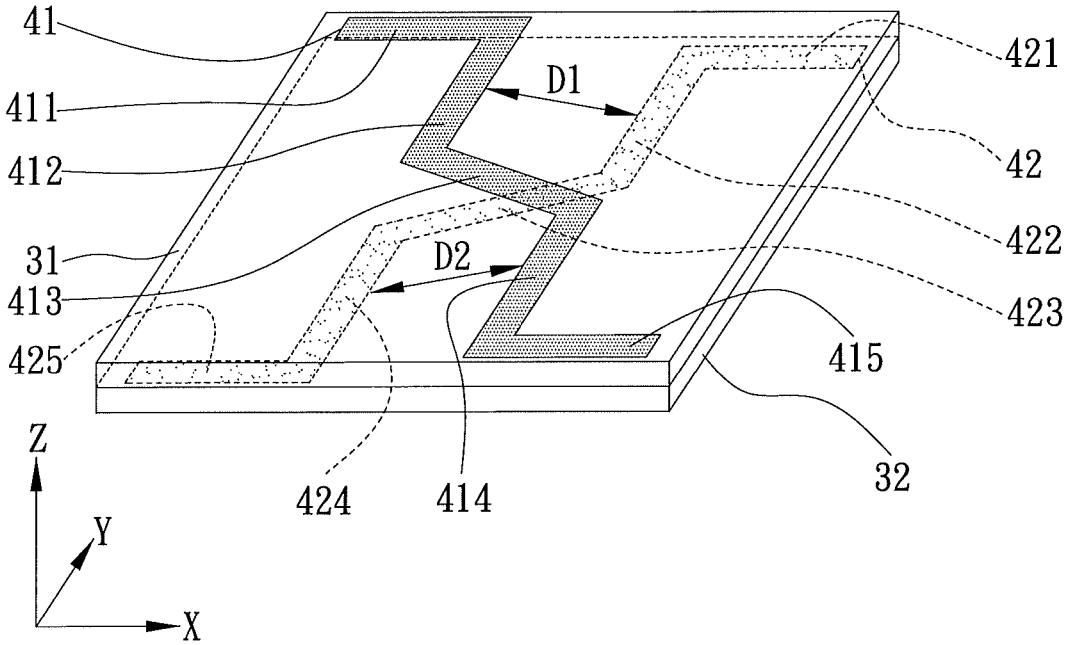
FIG. 3*b* is a local perspective view of the coupled inductor structure according to the present invention.

Taking FIG. 3*b* for reference, it is noted that the second bending segment 413 of the first inductor element 41 has on the second dielectric layer 32 a projection intersecting with the second bending segment 423 of the second inductor element 42, and the relative position of the first bending segment 412 of the first inductor element 41 to the first bending segment 422 of the second inductor element 42 is opposite to that of the relative position of the third bending segment 414 of the first inductor element 41 to the third bending segment 424 of the second inductor element 42.

Preferably, the first and second inductor elements 41, 42 are parallel to or substantially parallel to the surface defined by X-axis and Y-axis. Further, the first bending segments 412, 422 of the first and second inductor element 41, 42 are in parallel in a horizontal direction of Y-axis, and the third bending segments 414, 424 of the first and second inductor elements 41, 42 are also in parallel in a horizontal direction of Y-axis.

Furthermore, distance D1 between the first bending segments 412, 422 of the first and second inductor elements 41, 42 is substantially the same as distance D2 between the third bending segments 414, 424 of the first and second inductor elements 41, 42. The first bending segment 412 of the first inductor element 41 has a length substantially the same as that of the third bending segment 414 of the first inductor element 41. The first bending segment 422 of the second inductor element 42 has a length substantially the same as that of the third bending segment 424 of the second inductor element 42. The first bending segment 412 and the third bending segment 414 of the first inductor element 41, and the first bending segment 422 and the third bending segment 424 of the second inductor element 424 have substantially a same length. Length of the second bending segment 413 of the first inductor element 41 is substantially equal to that of the second bending segment 423 of the second inductor element 42.

With the arrangement as described above, even if a displacement in X-axis direction occurs during combining the first dielectric layer 31 with the second dielectric layer 32, deviation of the distance D1 between the first bending segment 412 and the first bending segment 422 can be offset by deviation of the distance D2 between the third bending segment 414 and the third bending segment 424, thereby preventing inductance value of the coupled inductor from exceeding a permissible range.

In addition, the plurality of dielectric layers 3 of the present embodiment further comprises a bottom layer 33 which functions as a bottom ground plane. The bottom layer 33 has two ground points 331, 332 respectively corresponding to the second signal connecting ports 415, 425 of the first and second inductor elements 41, 42. It is to be noted that quantity of the ground points 331, 332 depends on the number of the second signal connecting ports of the inductor elements.

The plurality of dielectric layers 3 further comprises third dielectric layers 34, 35 sandwiched between the second dielectric layer 32 and the bottom layer 33. It should be noted that the number of the third dielectric layers could be changed according to the practical need without departing from the scope of the invention. Capacitor elements 341, 351 are respectively disposed on the third dielectric layers 34, 35. In other embodiment, other passive elements can be disposed on the third dielectric layers 34, 35 and the number of the passive elements can be varied according to the practical need.

In the present embodiment, the third dielectric layer 34, 35 respectively have two electrically conductive through holes 342, 352. Thus, the second signal connecting port 415 of the first inductor element 41 is electrically connected to the ground point 331 through the electrically conductive through hole 321 of the second dielectric layer 32 and the electrically conductive through holes 342, 352 of the third dielectric layers 34, 35; and the second signal connecting port 425 of the second inductor element 42 is electrically connected to the ground point 332 through the electrically conductive through holes 342, 352 of the third dielectric layers 34, 35.

In the present embodiment, the plurality of dielectric layers 3 further comprises a top layer 36, which is a top ground plane. More specifically, the top layer 36 has two signal connecting points 361 and 362 respectively corresponding to the first signal connecting ports 411, 421 of the first and second inductor elements 41, 41

It should be noted that the second signal connecting ports 415, 425 of the first and second inductor elements 41, 42 may be some other signal connecting ports rather than the grounding ports and selectively connected to other elements or devices, as long as the electric potentials of the second signal connecting ports 415, 425 are equal to each other.

Second Embodiment

Figure 4A:
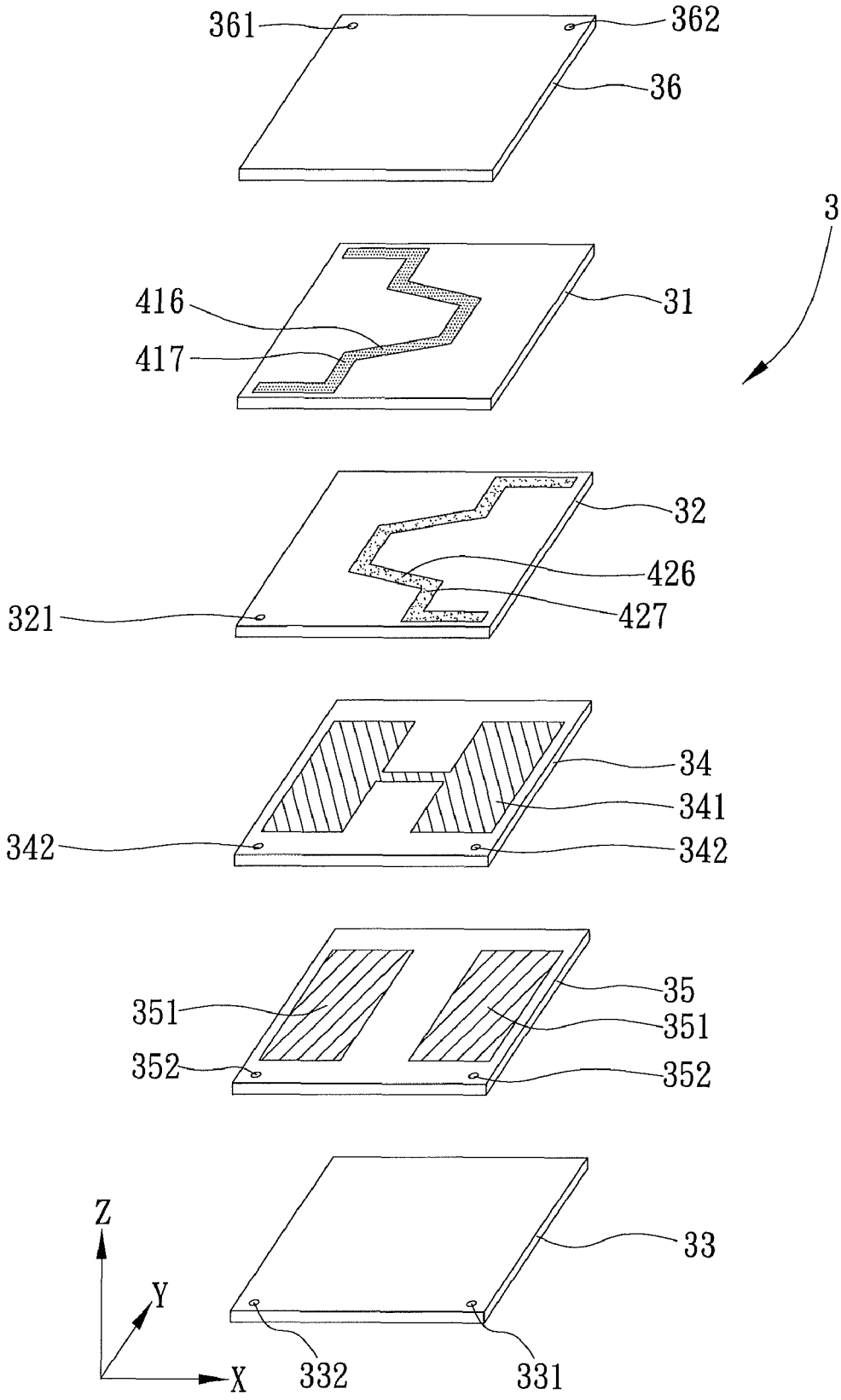
FIG. 4*a* is an exploded perspective view showing a coupled inductor structure according to another embodiment of the present invention.
Figure 4B:
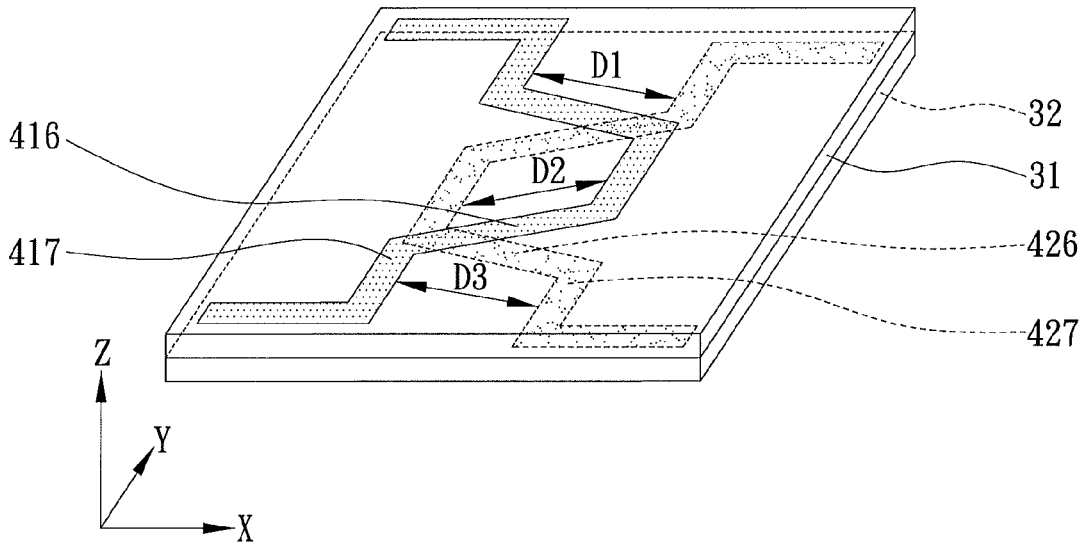
FIG. 4*b* is a local perspective view of the coupled inductor structure according to another embodiment of the present invention.

With reference to FIGS. 4*a* and 4*b*, a coupled inductor structure according to another embodiment of the present invention is shown. As shown in the drawings, the structure of the present embodiment is substantially same as the first embodiment. The only difference between them is that the first inductor element 41 further comprises a fourth bending segment 416 and a fifth bending segment 417 disposed between the third bending segment 414 and the second signal connecting port 415, wherein the fourth bending segment 416 is connected to the third bending segment 414, and the fifth bending segment 417 is connected to the fourth bending segment 416 and the second signal connecting port 415; and the second inductor element 42 further comprises a fourth bending segment 426 and a fifth bending segment 427 disposed between the third bending segment 424 and the second signal connecting port 425, wherein the fourth bending segment 426 is connected to the third bending segment 424, and the fifth bending segment 427 is connected to the fourth bending segment 426 and the second signal connecting port 425.

In the present embodiment, the projection of the second bending segment 413 of the first inductor element 41 on the second dielectric layer 32 intersects the second bending segment 423 of the second inductor elements 42, and the relative position of the first bending segment 412 of the first inductor element 41 to the first bending segment 422 of the second inductor element 42 is opposite to the relative position of the third bending segment 414 of the first inductor element 41 to the third bending segment 424 of the second inductor element 42, and the fourth bending segment 416 of the first inductor element 41 has on the second dielectric layer 32 another projection intersecting the fourth bending segment 426 of the second inductor element 42.

The relative position of the fifth bending segment 417 of the first inductor element 41 to the fifth bending segment 427 of the second inductor element 42 is same as the relative position of the first bending segment 412 of the first inductor element 41 to the first bending segment 422 of the second inductor element 42.

In addition, in the present embodiment, the first inductor element 41 and the second inductor element 42 are parallel to or substantially parallel to the surface defined by X-axis and Y-axis. The first bending segments 412, 422 of the first and second inductor elements 41, 42 are in parallel in a horizontal direction of Y-axis; the third bending segments 414, 424 of the first and second inductor elements 41, 42 are in parallel in a horizontal direction of Y-axis; and the fifth bending segments 417,427 of the first and second inductor elements 41, 42 are in parallel in a horizontal direction of Y-axis.

Further, distance D1 between the first bending segments 412, 422 of the first and second inductor elements 41, 42, distance D2 between the third bending segments 414, 424 of the first and second inductor elements 41, 42, and distance D3 between the fifth bending segments 417, 427 of the first and second inductor elements 41, 42 are substantially equal to each other.

Preferably, total length of the first bending segment 412 and the fifth bending segment 417 of the first inductor element 41 is substantially equal to the length of the third bending segment 414 of the first inductor element 41. Also, total length of the first bending segment 422 and the fifth bending segment 427 of the second inductor element 42 is substantially equal to the length of the third bending segment 424 of the second inductor element 42. The second bending segment 413 and the fourth bending segment 416 of the first inductor element 41, and the second bending segment 423 and the fourth bending segment 426 of the second inductor element 42 have substantially a same length.

The coupled inductor structure of the present invention not only can be used in disposing of inductors between multiple layers as described-above but also can be used in disposing of other passive elements so as to achieve passive circuits or impedance matching circuits of multi-layer structure. More specifically, the coupled inductor structure of the present invention can be applied in filter circuits. On the other hand, the multi-layer structure may be, but not limited to, a multi-layer flexible circuit board structure mainly made of flexible dielectric material. The coupled inductor structure of the present invention can further be applied in integrated circuits such as chips.

Moreover, in different embodiments, length and interval of bending segments of inductor elements in different layers can be adjusted according to the practical need.

The foregoing descriptions of the embodiments of the invention have been presented for the purposes of illustration and description. They are not intended to be exhaustive or to limit the invention to the precise forms disclosed. Persons skilled in the relevant art can appreciate that many modifications and variations are possible in light of the above teaching. It is therefore intended that the scope of the invention be limited not by this detailed description, but rather by the claims appended hereto.

What is claimed is:

1. A coupled inductor structure applied in a plurality of dielectric layers having at least one first dielectric layer and one second dielectric layer disposed under the first dielectric layer, the coupled inductor structure comprising:

at least one first inductor element disposed on the first dielectric layer, the first inductor element at least comprising a first signal connecting port, a first bending segment connected to the first signal connecting port, a second bending segment connected to the first bending segment, a third bending segment connected to the second bending segment, a fourth bending segment connected to the third bending segment, a fifth bending segment connected to the fourth bending segment and a second signal connecting port connected to the fifth bending segment; and at least one second inductor element disposed on the second dielectric layer, the second inductor element at least comprising a first signal connecting port, a first bending segment connected to the first signal connecting port, a second bending segment connected to the first bending segment, a third bending segment connected to the second bending segment, a fourth bending segment connected to the third bending segment, a fifth bending segment connected to the fourth bending segment and a second signal connecting port connected to the fifth bending segment, wherein the second bending segment of the first inductor element has on the second dielectric layer a projection intersecting the second bending segment of the second inductor element, relative position of the first bending segment of the first inductor element to the first bending segment of the second inductor element is opposite to the relative position of the third bending segment of the first inductor element to the third bending segment of the second inductor element, the fourth bending segment of the first inductor element has on the second dielectric layer another projection intersecting the fourth bending segment of the second inductor element, and the relative position of the fifth bending segment of the first inductor element to the fifth bending segment of the second inductor element is same as the relative position of the first bending segment of the first inductor element to the first bending segment of the second inductor element.

2. The coupled inductor structure as claimed in claim 1, wherein the first inductor element and the second inductor element are parallel to or substantially parallel to the surface defined by X-axis and Y-axis.

3. The coupled inductor structure as claimed in claim 1, wherein the first bending segments of the first and second inductor elements are in parallel in horizontal direction, the third bending segments of the first and second inductor elements are in parallel in horizontal direction, the fifth bending segments of the first and second inductor elements are in parallel in horizontal direction, the second bending segment of the first inductor element and the fourth bending segment of the second inductor element are in parallel in horizontal direction, and the fourth bending segment of the first inductor element and the second bending segment of the second inductor element are in parallel in horizontal direction.

4. The coupled inductor structure as claimed in claim 3, wherein distance between the first bending segments of the first and second inductor elements, distance between the third bending segments of the first and second inductor elements, and distance between the fifth bending segments of the first and second inductor elements are substantially equal to each other.

5. The coupled inductor structure as claimed in claim 1, wherein the total length of the first and fifth bending segments of the first inductor element is substantially equal to length of the third bending segment of the first inductor element, total length of the first bending segment and the fifth bending segment of the second inductor element is substantially equal to length of the third bending segment of the second inductor element.

6. The coupled inductor structure as claimed in claim 1, wherein the plurality of dielectric layers further comprises a bottom layer having at least two connecting points respectively corresponding to the second signal connecting ports of the first and second inductor elements.

7. The coupled inductor structure as claimed in claim 6, wherein the bottom layer is a bottom ground plane.

8. The coupled inductor structure as claimed in claim 6, wherein the plurality of dielectric layers further comprises at least a third dielectric layer disposed between the second dielectric layer and the bottom layer.

9. The coupled inductor structure as claimed in claim 8, wherein the third dielectric layer has at least a capacitor element disposed thereon.

10. The coupled inductor structure as claimed in claim 8, wherein the third dielectric layer has at least two electrically conductive through holes which respectively electrically connect the second signal connecting ports of the first and second inductor elements to the corresponding ground points.

11. The coupled inductor structure as claimed in claim 1 or 6, wherein the plurality of dielectric layers further comprises a top layer.

12. The coupled inductor structure as claimed in claim 11, wherein the top layer is a top ground plane.

13. The coupled inductor structure of claim 1, wherein at least one of the plurality of dielectric layers is made of a flexible dielectric material.

* * * * *